US009468232B2

(12) United States Patent
DeGuzman

(10) Patent No.: US 9,468,232 B2
(45) Date of Patent: Oct. 18, 2016

(54) CIGARILLO SPLITTER

(71) Applicant: Mario DeGuzman, Fairfield, CA (US)

(72) Inventor: Mario DeGuzman, Fairfield, CA (US)

( * ) Notice: Subject to any disclaimer, the term of this patent is extended or adjusted under 35 U.S.C. 154(b) by 157 days.

(21) Appl. No.: 14/489,021

(22) Filed: Sep. 17, 2014

(65) Prior Publication Data

US 2016/0073683 A1 Mar. 17, 2016

(51) Int. Cl.

| | |
|---|---|
| ***A24C 1/04*** | (2006.01) |
| ***A24C 1/38*** | (2006.01) |
| ***A24C 5/60*** | (2006.01) |

(52) U.S. Cl.

CPC ..... *A24C 1/04* (2013.01); *A24C 1/045* (2013.01); *A24C 1/386* (2013.01); *A24C 5/606* (2013.01); *A24C 5/607* (2013.01)

(58) Field of Classification Search

CPC ..... A24C 1/04; A24C 1/045; A24C 5/606; A24C 5/607; A24C 5/007; A24C 1/386

See application file for complete search history.

(56) References Cited

U.S. PATENT DOCUMENTS

| | | | | |
|---|---|---|---|---|
| 334,686 | A * | 1/1886 | Bayler | A24C 1/386 131/254 |
| 396,801 | A * | 1/1889 | Bernhardt | A24C 1/386 131/254 |
| 3,741,220 | A * | 6/1973 | Meinunger | A24C 5/42 131/70 |
| 4,054,146 | A * | 10/1977 | Ortiz, Jr. | A24F 13/24 131/329 |
| 4,231,378 | A * | 11/1980 | Stevens | A24F 13/24 131/253 |
| 4,246,912 | A * | 1/1981 | Landuydt | A24F 13/24 131/254 |
| 2010/0059072 | A1 * | 3/2010 | Woodson | A24B 15/282 131/274 |

OTHER PUBLICATIONS

Juan C. Blanco, Innovation Direct Designated to Represent Cigarillo Perforator Splitter Invention for Next 2 Years, Mar. 6, 2014.*

* cited by examiner

*Primary Examiner* — Anthony Calandra
(74) *Attorney, Agent, or Firm* — Gulf Coast Intellectual Property Group

(57) ABSTRACT

A cigarillo splitter operable to create a row of apertures in the external wrap of a cigarillo in order to facilitate the splitting of the external wrap. The cigarillo splitter further includes a first plate member and a second plate member that are rectangular in shape and of the same size. The first plate member and second plate member are hingedly attached wherein the first plate member has a first position and a second position. The first plate member includes a plurality of pins oriented in a row extending the length of the first plate member. A groove is formed in the second plate member and is in axial alignment with the plurality of pins. A spacer is secured intermediate the first plate member and second plate member to ensure a parallel orientation when the first plate member is in its second position.

7 Claims, 2 Drawing Sheets

CIGARILLO SPLITTER

PRIORITY UNDER 35 U.S.C SECTION 119(e) & 37 C.F.R. SECTION 1.78

This nonprovisional application claims priority based upon the following prior U.S. Provisional Patent Application entitled: Cigarillo Perforator Splitter, Application No.: 61/896,706, filed Oct. 29, 2013, in the name of Mario De Guzman, which is hereby incorporated by reference for all purposes.

FIELD OF THE INVENTION

The present invention relates generally to tobacco accessories, more specifically but not by way of limitation a cigarillo splitting device that is operable to create a perforated edge along the outer tobacco leaf or tobacco based paper wrapper wherein the perforated edge extends intermediate the ends of the cigarillo and facilitates the splitting thereof.

BACKGROUND

Tobacco products and smoking have been a part of human culture for thousands of years. Whether it was part of ancient tribal ceremonial rituals or an indulgence of modern behavior smoking various types of tobacco is very common. Tobacco is smoked is many forms including but not limited to cigarettes, cigars, loose pipe tobacco and cigarillos. These forms of tobacco all offer unique experiences to the user and provide enjoyment of the different types of tobacco.

It is very popular to utilize existing wrappers from cigars and or cigarillos as a wrapper for a custom blend. For example but not by way of limitation, if a tobacco user wishes to create a blend of cherry tobacco leaves and chocolate tobacco leaves, it is common for a user to purchase off-the-shelf pre-made cigarillos and split the outer wrapper so as to empty the contents thereof and then fill/reseal with a special blend desired by the user. As is known in the art, cigarillos have an external wrap of a thick tobacco leaf or a tobacco based paper. This external wrap can be split from end to end so as to facilitate the removal of the tobacco leaves inside. Once the tobacco leaves are removed and alternate tobacco leaves are filled therein, the external wrap can be resealed with water or similar technique.

One problem with existing cigarillo splitters is that they damage the external wrap. Common cigarillo splitters are manufactured from a tube that is hollow having a sufficient diameter to receive a cigarillo therethrough. As a cigarillo is passed through the splitter, a blade extending downward from the inside of the tube will cut the wrapper. One problem with this device and technique is that it can damage the external wrapper such that resealing is very difficult. Also, if the product inside consists of rolled tobacco leaves, this style of splitter causes damage to those leaves as well.

Accordingly, there is a need for a cigarillo splitter that can facilitate the splitting of the external wrap of a cigarillo with minimal damage thereto and further without damaging the internal tobacco leaves.

SUMMARY OF THE INVENTION

It is the object of the present invention to provide a cigarillo splitter that facilitates the splitting of the external wrap of the cigarillo wherein the present invention provides a perforated edge extending the length of the cigarillo in the external wrap so as to facilitate the splitting of the external wrap of the cigarillo.

Another object of the present invention is to provide a cigarillo splitter operable to produce a perforated edge in the external wrap of a cigarillo wherein the cigarillo splitter includes a bottom plate and a top plate that are hingedly secured.

A further object of the present invention is to provide a cigarillo splitter operable to produce a perforated edge extending the length of the cigarillo in the external wrap thereof that further includes a spacer adjacent the hinged edges of the top plate and bottom plate.

An additional object of the present invention is to provide a cigarillo splitter that is operable to produce a perforated edge line in the external wrap of a cigarillo extending the length thereof wherein the bottom plate includes a groove running the length of the bottom plate that has a radius operable to receive a cigarillo therein.

Yet another object of the present invention is to provide a cigarillo splitter that is operable to produce a perforated edge line in the external wrap of a cigarillo that includes a plurality of pins secured to the interior surface of the top plate wherein the pins are in axial alignment with the groove on the bottom plate.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
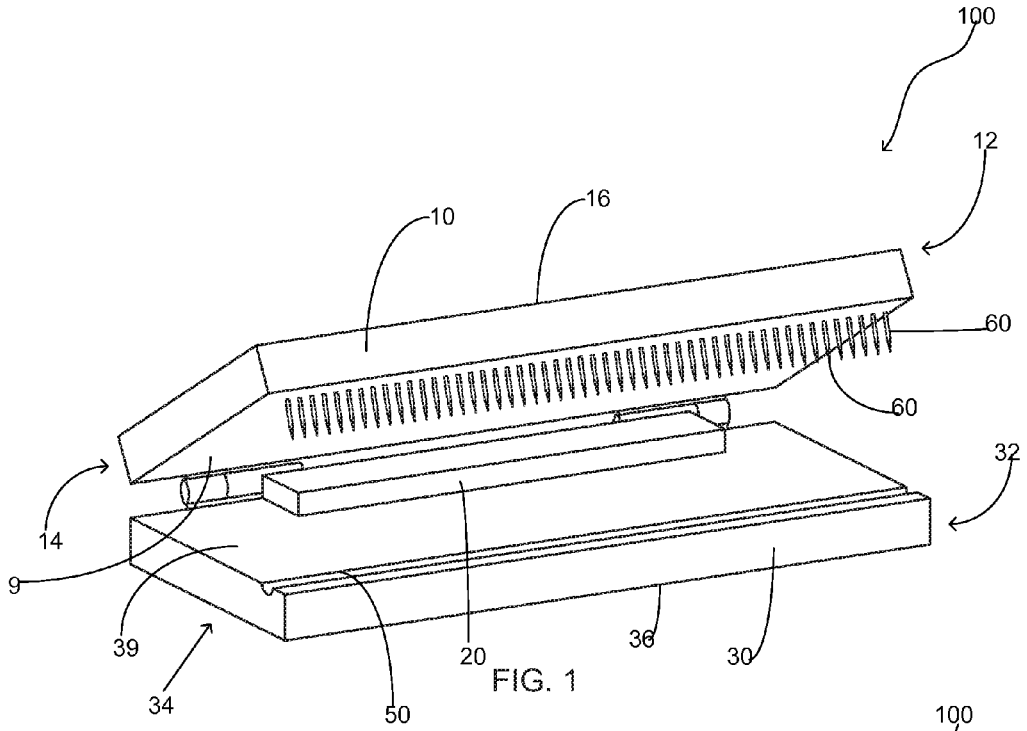
FIG. 1 is front view of the present invention in a partially opened position.

Referring now to the drawings submitted herewith, wherein various elements depicted therein are not necessarily drawn to scale and wherein through the views and figures like elements are referenced with identical reference numerals, there is illustrated a cigarillo splitter 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring to the drawings submitted herewith the cigarillo splitter 100 includes a first plate member 10 that is rectangular in shape and is manufactured from a suitable durable material such as but not limited to wood or plastic. The first plate member 10 includes a first end 12 and a second end 14. A first longitudinal edge 16 and a second longitudinal edge extend 18 intermediate the first end 12 and second end 14. The first plate member 10 includes an exterior surface 8 and an interior surface 9. Secured to the interior surface 9 of the first plate member 10 are a plurality of pins 60. The pins 60 are secured to the interior surface 8 of the first plate member 10 utilizing suitable durable techniques. The pins 60 are arranged in axial alignment with one another and are proximate the first longitudinal edge 16 being parallel therewith. The pins 60 are spaced approximately two to four millimeters apart and extend substantially the length intermediate the first end 12 and second end 14. The pins 60 serve to create a perforation line in the external wrap of a cigarillo that has been engaged with the cigarillo splitter 100. As further discussed herein, the plurality of pins 60 are of sufficient length to pierce an external wrap of a cigarillo when the first plate member 10 is placed in its closed position. The pins 60 pierce the external wrap creating small adjacent holes that facilitate the removing of the external wrap of a cigarillo in order to subsequently fill the external wrap with a different blend of tobacco or tobacco products. While good results have been achieved utilizing a plurality of pins 60 that are spaced two to four millimeters apart, it is contemplated within the scope of the present invention that the pins 60 could be spaced at different distances and still create the perforated line of apertures in the external wrap of a cigarillo.

Figure 2:
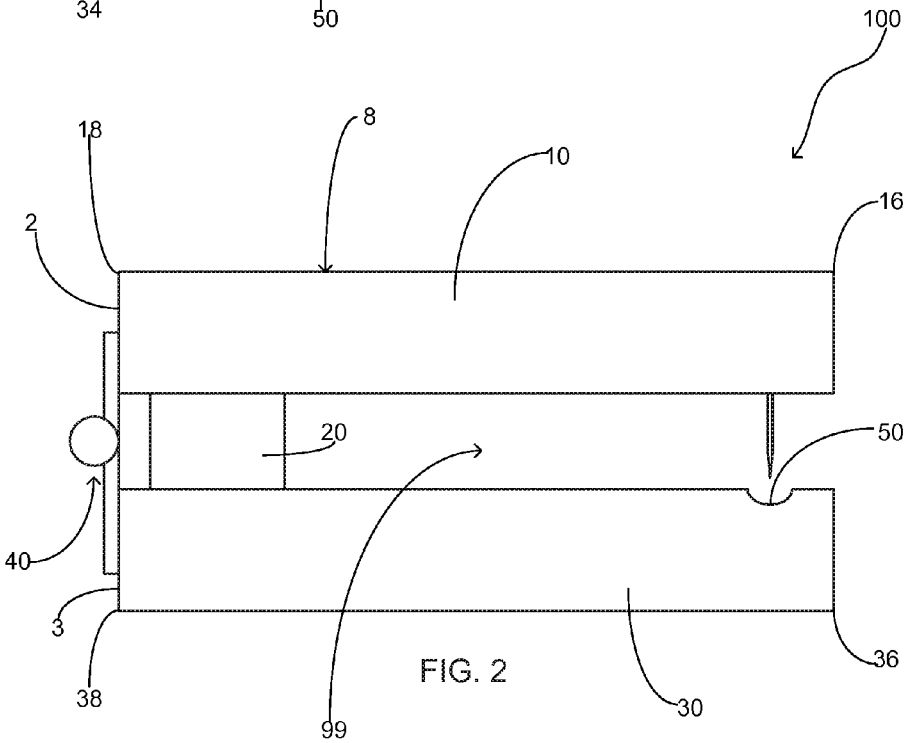
FIG. 2 is a side view of the present invention in a closed position.
Figure 3:
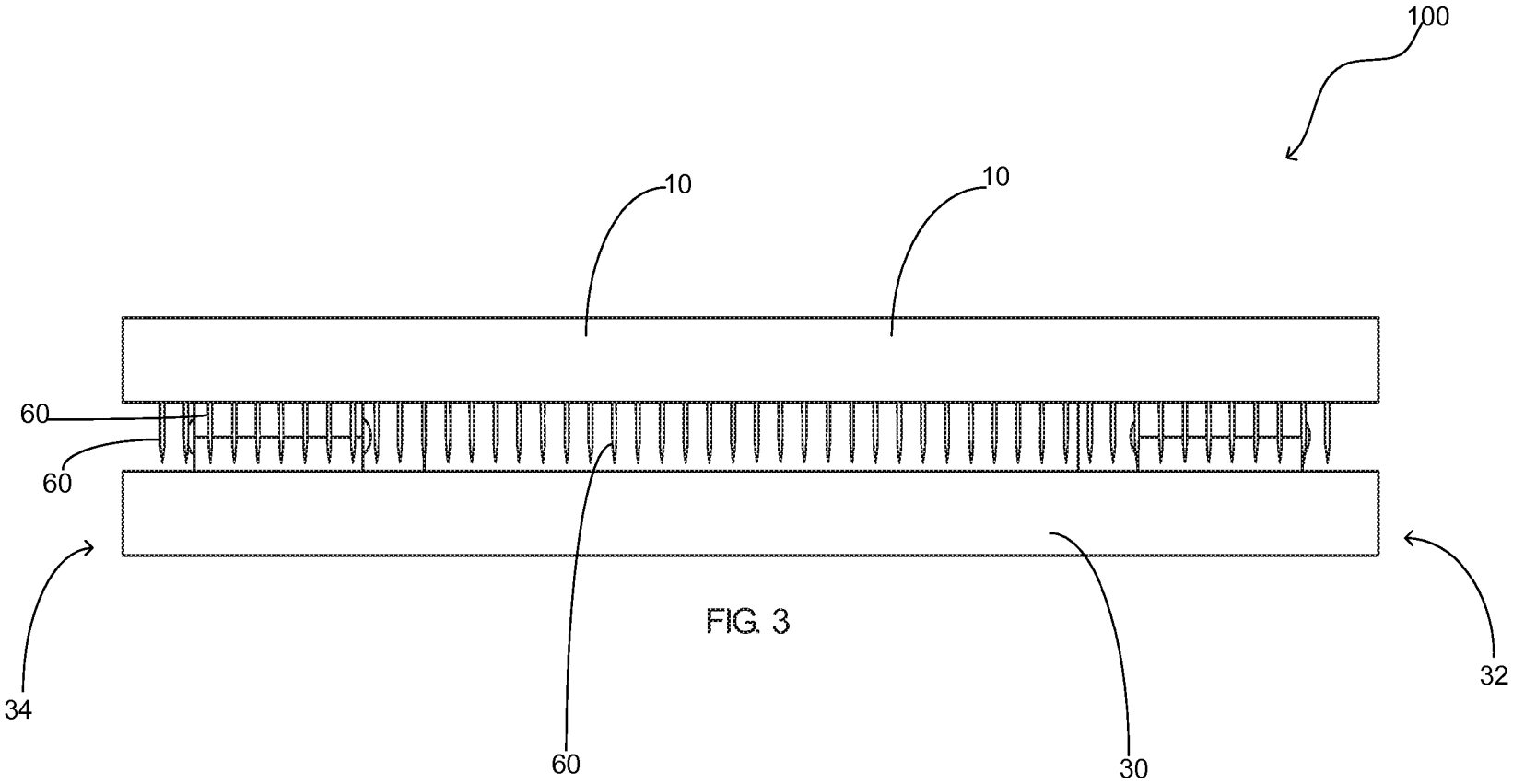
FIG. 3 is a front view of the present invention in a closed position.

A second plate member 30 is hingedly secured to the first plate member 10. The second plate member 30 is rectangular in shape being manufactured from a suitable durable material such as but not limited to wood or plastic. The second plate member 30 is the same size as the first plate member 10. The second plate member 30 includes a first end 32 and a second end 34 with a first longitudinal edge 36 and a second longitudinal edge 38 extending therebetween. The second plate member 30 includes an upper surface 39 that is oriented to face towards the first plate member 10 when the first plate member 10 is in its closed position as shown herein in FIG. 2. Formed into the upper surface 39 of the second plate member 30 is groove 50. Groove 50 extends the length of the second plate member 30 intermediate first end 32 and second end 34. The groove 50 is u-shaped having a sufficient radius to receive and retain therein a cigarillo. The shape of the groove 50 mateably connects with the round shape of a cigarillo and functions to assist in the maintenance of the stability of a cigarillo during the positioning of the first plate member 10 to its closed position in order for the pins 60 to penetrate the external wrap of the cigarillo to create a perforated line of apertures. The depth of the groove 50 is approximately one half the diameter of a conventional cigarillo.

The first plate member 10 and the second plate member 30 are hingedly secured using hinge 40. Hinge 40 is a conventional barrel style hinge and is secured to the rear wall 2 of the first plate member 10 and the rear wall 3 of the second plate member 30 utilizing suitable durable techniques such as but not limited to screws. The hinge 40 facilitates the movement of the first plate member 10 in relation to the second plate member 30. As shown in FIG. 1 herein, the first plate member 10 is hingedly moved away from the second plate member 30 in order to facilitate access to the groove 50 so a cigarillo may be placed therein. In its second position, the first plate member 10 is hingedly moved towards the second plate member 30 wherein the first plate member 10 and the second plate member 30 are parallel as shown herein in FIG. 2. In this position, the pins 60 will pierce the external wrap of a cigarillo disposed in the groove 50. It is contemplated within the scope of the present invention that the cigarillo splitter 100 could have one hinge 40 or a plurality of hinges.

A spacer 20 is secured to the upper surface 39 of the second plate member 30 and is proximate the second longitudinal edge 38. The spacer 20 is secured utilizing suitable durable techniques and is manufactured from a suitable durable material such as but not limited to plastic or wood. The spacer is rectangular in shape and functions to provide a permanent spacing between the operably coupled first plate member 10 and second plate member 30. The void 99 created by the spacer 20 when the first plate member 10 is in its closed position functions to facilitate the correct positioning of the first plate member 10 and the depth of travel of the pins 60. The spacer 20 is sized such that in its closed position, the first plate member 10 does not exceed an angle of being parallel with the second plate member 30 and that the pins 60 puncture only the external wrap of a cigarillo disposed in the groove 50.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A cigarillo splitter comprising:

a first plate member, said first plate member being rectangular in shape;

a second plate member, said second plate member being rectangular in shape, said second plate member being operably coupled to said first plate member;

a plurality of pins, said plurality of pins secured to said first plate member, said plurality of pins being intermediate said first plate member and said second plate member, said plurality of pins being oriented in a straight line, said plurality of pins extending downward from said first plate member towards said second plate member, wherein said plurality of pins are in axial alignment with said groove;

a spacer, said spacer being secured to said second plate member, said spacer operable to ensure said first plate member is parallel to said second plate member when said first plate member is in its closed position;

at least one hinge, said at least one hinge operable to movably couple said first plate member and said second plate member;

a groove, said groove being formed in said second plate member, said groove operable to receive and retain a cigarillo, said groove being in alignment with said plurality of pins.

2. The cigarillo splitter as recited in claim 1, wherein said first plate member in its second position will facilitate piercing of an external wrap of a cigarillo by said plurality of pins.

3. The cigarillo splitter as recited in claim 2, wherein said first plate member is hinged away from said second plate member in its first position.

4. A cigarillo splitter operable to create a perforated line of apertures in the external wrap of a cigarillo comprising:

a first plate member, said first plate member being rectangular in shape, said first plate member having a first end and a second end, said first plate member having an interior surface and an exterior surface;

a second plate member, said second plate member being rectangular in shape, said second plate member being the same size as said first plate member, said second plate member having a first end and a second end, said second plate member having an interior surface;

a row of pins, said row of pins being secured to said interior surface of said first plate member, said row of pins extending intermediate said first end and said second end of said first plate member, said row of pins extending downward from said first plate member, said row of pins operable to pierce a plurality of apertures in the external wrap of a cigarillo, wherein said row of pins are operable to engage a cigarillo disposed in said groove ensuing said first plate member being placed in said second position;

a spacer, said spacer being secured to said interior surface of said second plate member, said spacer operable to ensure said first plate member is parallel to said second plate member subsequent said first plate member being moved to its second position;

at least one hinge, said at least one hinge operable to movably couple said first plate member and said second plate member; and a groove, said groove being formed in said interior surface of said second plate member, said groove being in axial alignment with said row of pins, said groove extending intermediate said first end and said second end of said second plate member, said groove operable to receive a cigarillo, wherein said groove is u-shaped.

5. The cigarillo splitter as recited in claim 4, wherein said row of pins are in axial alignment with said groove.

6. A cigarillo splitter operable to create a row of apertures in an external wrap of a cigarillo so as to facilitate the subsequent splitting of the external wrap comprising:

a first plate member, said first plate member being rectangular in shape, said first plate member having a first end and a second end, said first plate member having an interior surface and an exterior surface, said first plate member further including a first longitudinal edge and a second longitudinal edge, said first longitudinal edge being opposite said second longitudinal edge;

a second plate member, said second plate member being rectangular in shape, said second plate member being the same size as said first plate member, said second plate member having a first end and a second end, said second plate member having an interior surface, said second plate member further including a first longitudinal edge and a second longitudinal edge, said first longitudinal edge being opposite said second longitudinal edge;

a row of pins, said row of pins being secured to said interior surface of said first plate member, said row of pins being proximate said first longitudinal edge of said first plate member, said row of pins extending intermediate said first end and said second end of said first plate member, said row of pins extending downward from said first plate member, said row of pins operable to pierce a plurality of apertures in the external wrap of a cigarillo, wherein said row of pins are in axial alignment with said groove;

a groove, said groove being formed in said interior surface of said second plate member, said groove being in axial alignment with said row of pins, said groove extending intermediate said first end and said second end of said second plate member, said groove operable to receive a cigarillo;

a spacer, said spacer being secured to said interior surface of said second plate member, said spacer operable to ensure said first plate member is parallel to said second plate member subsequent said first plate member being moved to its second position;

at least one hinge, said at least one hinge operable to movably couple said first plate member and said second plate member; and wherein said first plate member has a first position and a second position, in said second position said row of pins being operable to engage a cigarillo disposed in said groove.

7. The cigarillo splitter as recited in claim 6, wherein said row of pins are in axial alignment with said groove.

* * * * *